United States Patent [19]

Ottieri

[11] Patent Number: 4,691,454

[45] Date of Patent: Sep. 8, 1987

[54] SKI BOOT CLOSURE SYSTEM

[75] Inventor: Marco T. Ottieri, Manchester, Mass.

[73] Assignee: Ottieri Enterprises, Boston, Mass.

[21] Appl. No.: 820,405

[22] Filed: Jan. 17, 1986

Related U.S. Application Data

[63] Continuation-in-part of Ser. No. 655,905, Sep. 28, 1984, Pat. No. 4,669,202, and a continuation-in-part of Ser. No. 664,991, Oct. 26, 1984, Pat. No. 4,565,017.

[51] Int. Cl.[4] ..... A43B 5/04; A43C 11/00

[52] U.S. Cl. ..... 36/117; 36/50; 36/120; 24/68 SK

[58] Field of Search ..... 36/117–121, 36/50; 24/68 SK, 69 SK, 70 SK, 71 SK

[56] References Cited

U.S. PATENT DOCUMENTS

| | | | |
|---|---|---|---|
| 3,775,872 | 12/1973 | Rathmell . | |
| 4,160,332 | 7/1979 | Salomon . | |
| 4,190,970 | 3/1980 | Annovi . | |
| 4,196,530 | 4/1980 | Delery . | |
| 4,222,184 | 9/1980 | Kastinger . | |
| 4,338,735 | 7/1982 | Spademan . | |
| 4,408,403 | 10/1983 | Martin | 36/50 X |
| 4,571,855 | 2/1986 | Blanc | 36/50 |

FOREIGN PATENT DOCUMENTS

| | | | |
|---|---|---|---|
| 0053340 | 6/1982 | European Pat. Off. | 36/120 |
| 3442780 | 6/1985 | Fed. Rep. of Germany | 36/117 |
| 3406591 | 8/1985 | Fed. Rep. of Germany | 36/117 |
| 3532455 | 4/1986 | Fed. Rep. of Germany | 36/117 |

*Primary Examiner*—James Kee Chi

*Attorney, Agent, or Firm*—Lahive & Cockfield

[57] ABSTRACT

The present invention comprises a ski boot closure for rear-entry ski boots. In this closure mechanism a latch mechanism having a lever, which is movable between open and closed positions, operates a cable system having height and length varying strands. The cable system originates in the latch mechanism and passes around either side the calf cuff of the boot to become secured to the shin cuff. The boot is opened as an adjustment of the latch mechanism lengthens the cable strands surrounding the calf cuff. Conversely, the boot as closed as an adjustment of the latch mechanism shortens the cable strands surrounding the calf cuff thus causing the calf and shin cuffs of the boot to be moved into frictional engagement.

12 Claims, 5 Drawing Figures

SKI BOOT CLOSURE SYSTEM

CROSS-REFERENCE TO RELATED APPLICATION

This application is a continuation-in-part of co-pending U.S. application Ser. No. 655.905, filed Sept. 28, 1984, now U.S. Pat. No. 4,669,202, issued June 2, 1987, and a continuation-in-part of Ser. No. 664,991, filed Oct. 26, 1984, U.S. Pat. No. 4,565,017, issued Jan. 21, 1986.

BACKGROUND OF THE INVENTION

1. Field of the Invention

This invention relates generally to ski boots. More particularly, this invention is directed to a closure system for ski boots.

2. Prior Art

Ski boots have undergone many changes in recent years. A change of particular significance is that many ski boot manufacturers are now offering rear entry ski boots which allow the wearer to put on and take off the boot with greater ease.

Although there is now a great variety of rear entry ski boots, there remains a need for such a boot which combines ease of entry and exit with an effective and convenient closure system. Accordingly, it is an object of the present invention to provide a rear entry ski boot with a single closure mechanism which offers high effectiveness and great convenience. The closure mechanism of this invention also contributes to the ease of ski boot manufacture.

SUMMARY OF THE INVENTION

A ski boot according to the invention has a foot-supporting base element that provides sole, toe and instep portions. The sole portion has heel, arch and ball sections. The base element mounts three further boot elements that supportingly engage the wearer. One is a forward shin cuff element for supportingly engaging the shin of the wearer. Another is a rear calf cuff element that supportingly engages the calf of the wearer. The third is a rear heel element that supportingly engages that back of the heel and ankle of the wearer. The three elements may be hingedly mounted to the base element and are movable between closed positions in which they provide shin, calf, heel and ankle supporting engagements, and open positions in which they allow the wearer to step in and alternatively out of the ski boot with relative ease.

In another embodiment the ski boot may be constructed such that the shin cuff is rigidly joined to the base element while the calf cuff and heel elements are hingedly mounted to the base element.

The general construction of a ski boot according to this invention is further described in co-pending U.S. applications Ser. Nos. 655,905, filed Sept. 28, 1984, and 664,991, filed Oct. 26,1984, (now U.S. Pat. No. 4,565,017), both of which are hereby incorporated by reference.

In accordance with the invention, a rear-entry ski boot features a cable system activated by a rear-mounted latch mechanism, which controls the opening and closing of the boot. The cable system is connected between a pivotal calf cuff and a shin cuff of the boot. When tension is applied to the cable by engaging the latch mechanism, the cable's position on the shin and calf cuffs of the boot is elevated and the relative length of the cable passing around the boot is shortened. This action forces the calf cuff to frictionally engage the shin cuff, thereby closing the boot. Conversely, disengagement of the latch mechanism opens the boot by both lowering and increasing the relative length of the cable surrounding the calf and shin cuffs of the boot, allowing the calf cuff to pivot away from the shin cuff.

In its preferred embodiment, the closure of this invention has a latch mechanism mounted to the calf cuff of the boot. This latch mechanism comprises a guide track and a lever which is slideably mounted to the guide track. The lever has a handle portion at one end which is free to pivot away from the boot. Opposite the handle end is a sliding end which is slidably and pivotally mounted to the guide track. The lever is also hingedly connected, at an intermediate position on the lever, to one end of a fulcrum arm. The other end of the fulcrum arm hingedly mounts to a flange on the boot which is adjacent the lower end of the guide track. Preferably, the mounting point of the fulcrum to the lever lies between the longitudinal midpoint of the lever and the lever's sliding end. In addition this mounting point is located outside (away from the top of the boot) of the lateral midpoint of the lever.

The lever is adapted for movement between open and closed positions. In the open position the handle end of the lever is pivoted away from the calf cuff and the sliding end of the lever is positioned at a selected position below the uppermost portion of the guide track. In the closed position the handle end of the lever is substantially flush with the calf cuff and the sliding end of the lever is proximate to the uppermost portion of the guide track. At all times the movement of the handle end of the lever causes the lever to pivot about two points: the mounting point of the fulcrum to the lever and the mounting point of the sliding end of the lever to the guide track.

The lever operates a cable, or similar tensile strap, to facilitate opening and closing of the boot. The cable is secured to the sliding end of the lever and is threaded downwardly therefrom, in two adjacent strands, within a central channel of the guide track. At the lower end of the guide track the adjacent cable strands diverge and each pass around separate sheaves located on either side of the lower portion of the guide track. Each cable strand then passes around the calf cuff at its respective side of the boot, to the front of the skin cuff where the cable is secured to a tensile element which is attached to the front of the shin cuff.

Preferably, the cable is of a single, continuous length. The cable may be adjustable at the point of attachment to the sliding end of the lever, or alternatively, the cable may be adjusted by way of an adjustable tensile element mounted to the front of the shin cuff.

When the lever is in the open position, the point of attachment of the cable to the lever is lowered along the calf cuff thereby freeing the boot to open. In other words, with the boot in the closed position, the length of cable contained within the central channel of the guide track, between the sliding end of the lever and the sheaves, is significantly greater in length than the cable in such position when the boot is in the open position. Therefore, positioning the lever in the open and closed positions increases and decreases respectively, the relative length of cable available to pass around the calf and shin cuff elements of the boot.

BRIEF DESCRIPTION OF DRAWINGS

For a fuller understanding of the nature and object of the invention, reference should be made to the following detailed description and the accompanying drawings, in which.

DESCRIPTION OF ILLUSTRATED EMBODIMENTS

Figure 1:
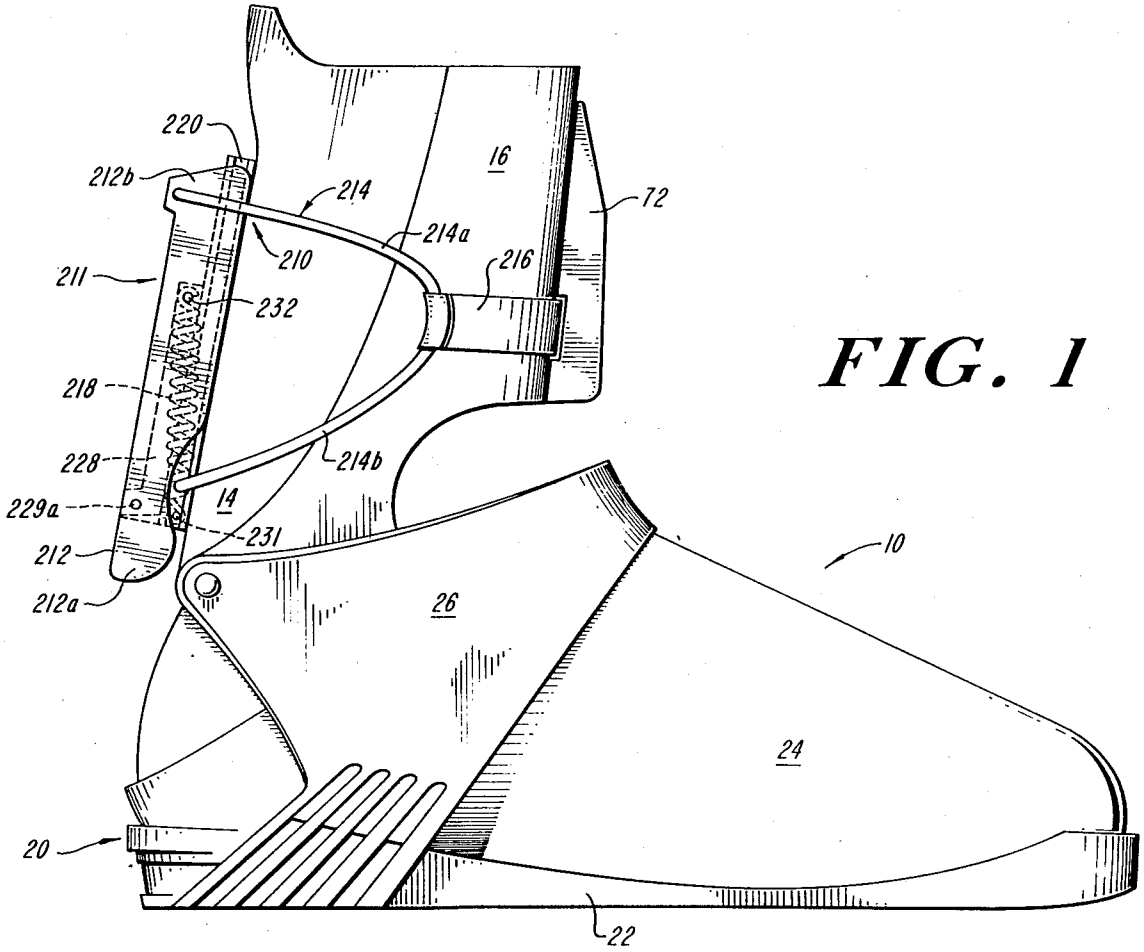
FIG. 1 is a side view of a ski boot illustrating a closure system according to the invention in the closed position.

FIGS. 1 through 4 illustrate a ski boot closure system 210 of the present invention. The closure system 210, shown in the closed position in FIG. 1, is mounted to the calf cuff 14 of a ski boot 10. The ski boot also comprises a base element 20 having sole 22, toe 24, and instep portions 26, as well as a shin cuff 16. The calf cuff is hingedly mounted to the base element for supportingly engaging the calf of the wearer. The closure system 210 comprises a latch mechanism 211 mounted to the calf cuff 14 of the boot and a cable system, generally designated as reference numeral 214, which is secured to a strap 216 mounted to the shin cuff 16 of the boot.

Figure 2A:
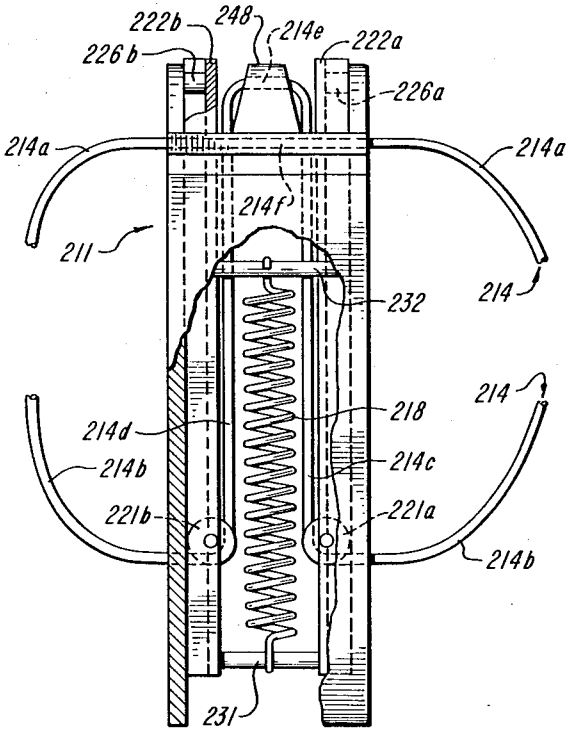
FIG. 2*a* is a partly fragmented front view of the latch mechanism of the closure system of FIG. 1.
Figure 2:
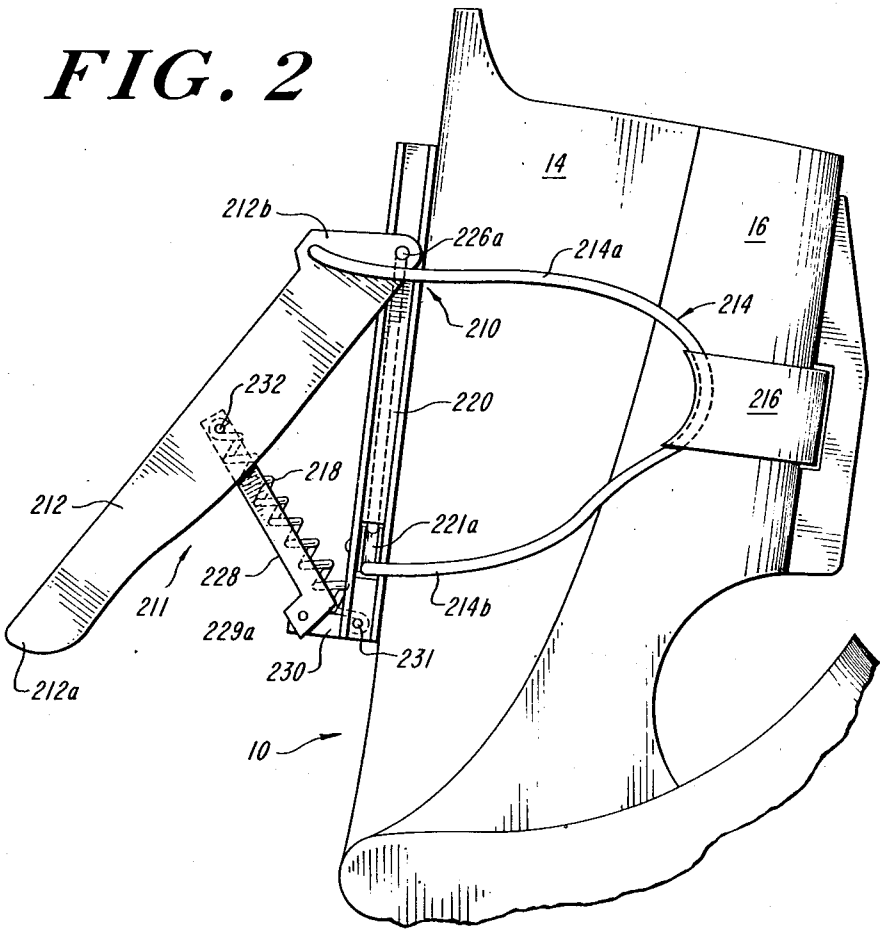
FIG. 2 is a partly broken away side view of the closure system of FIG. 1 in the partially open position.
Figure 3:
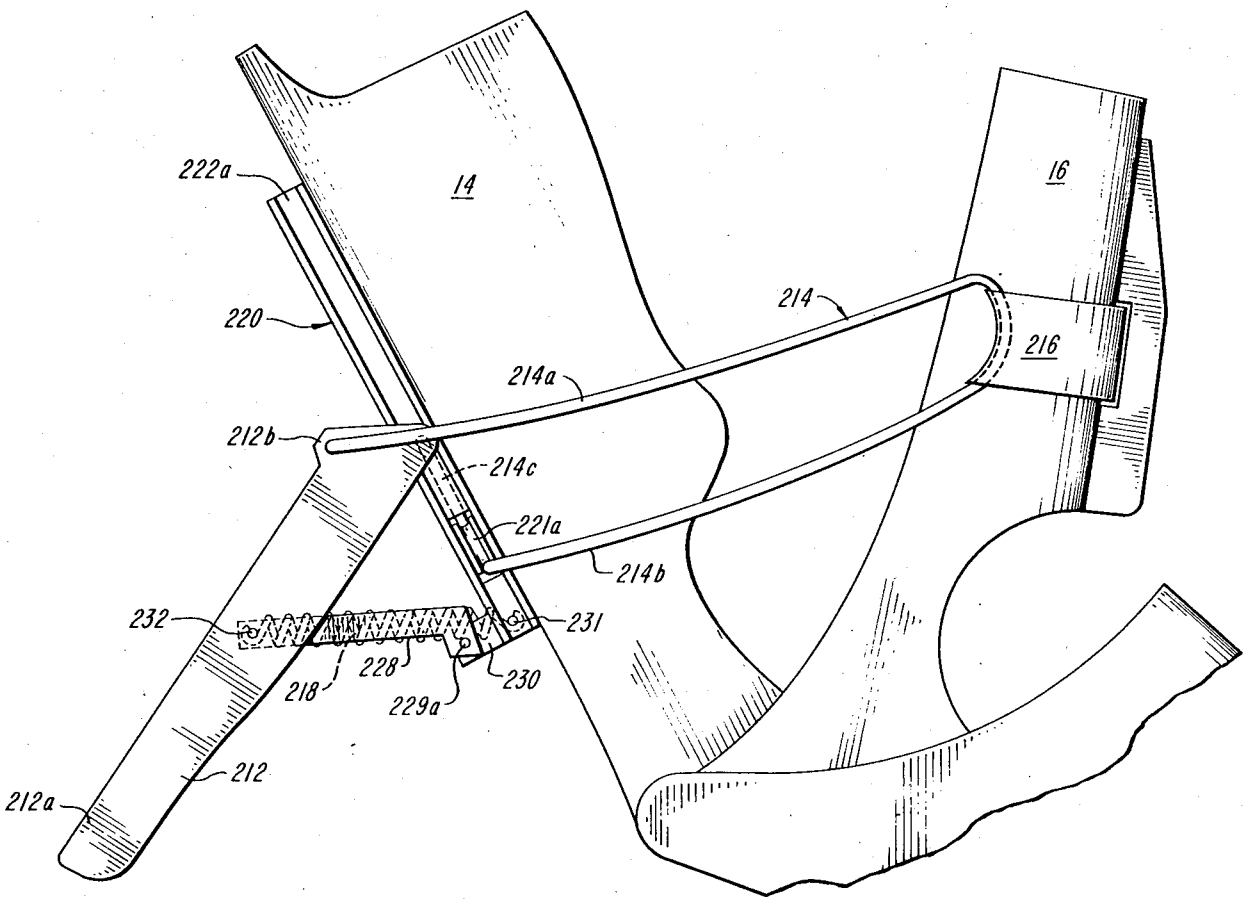
FIG. 3 is a partly broken away side view of a ski boot illustrating the closure system of FIG. 1 in the open position.

The latch mechanism 211 employs a lever 212 which is pivotally and slidably mounted at its upper end to a guide track 220, and which upper end is adapted for vertical movement relative to the guide track 220, as shown in FIGS. 2 and 3. The lever 212 may be a relatively flat, elongate member which is constructed of a durable plastic material or a lightweight metal. The lever 212 has a handle end 212*a* which is manually accessible to allow the lever to be moved to open and closed positions, and a sliding end 212*b* which is pivotally and slidably mounted to a guide track 220.

The guide track 220 (shown in FIG. 4) is mounted, in vertical orientation, to the upper portion of calf cuff 14. The guide track 220 is formed by adjacent, outwardly facing channel members 222*a* and 222*b* which are separated by a central channel area 224. The channel members 222*a*, 222*b* are joined preferably by a flat connecting member which defines one side of the central channel 224 and which is mounted to the calf cuff 14. The guide track 220 is preferably constructed of a durable plastic material or a lightweight metal having a relatively low coefficient of friction to facilitate ease of sliding.

Figure 4:
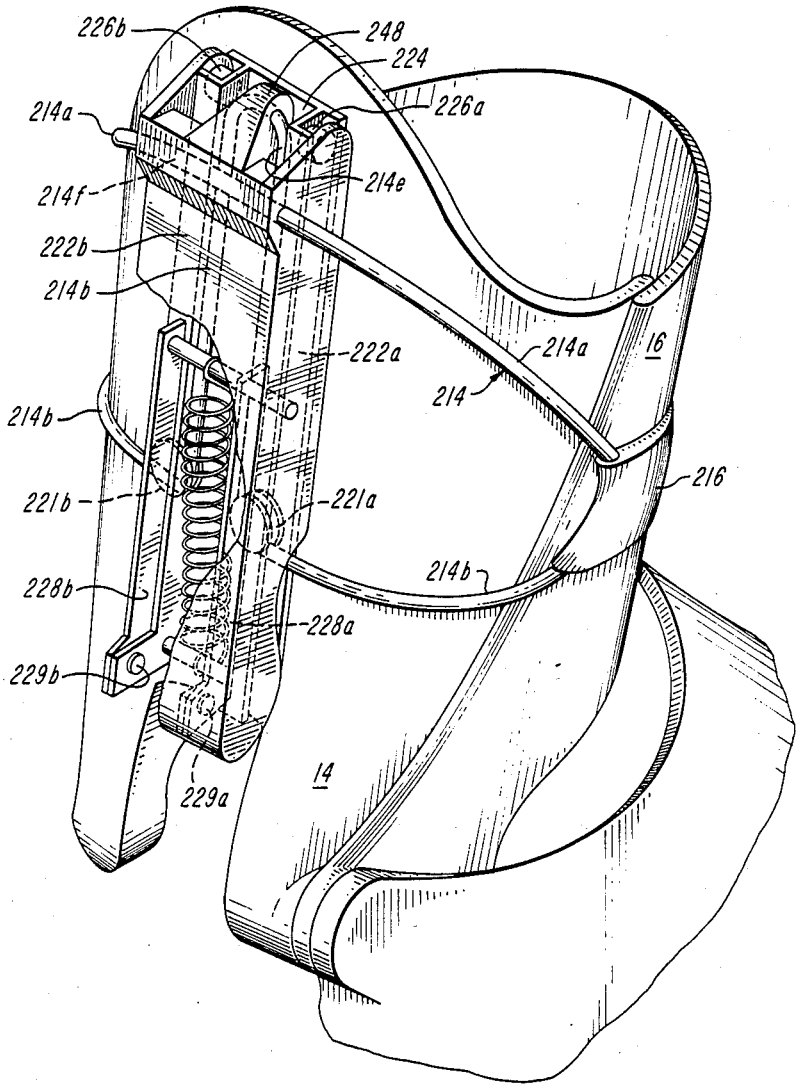
FIG. 4 is a partly broken away fragmented perspective view of the closure system of FIG. 1.

As illustrated in FIGS. 2, 2*a*, and 4, the lever 212 is pivotally and slidably mounted at its upper end to the channel members 222*a*, 222*b* by pins 226*a*, 226*b*. Pins 226*a*, 226*b* are adapted to slide and rotate within the guide track 220 to allow the lever 212 to pivot and to move vertically relative the guide track 220. The lever 212 is also hingedly mounted, at or near its longitudinal midpoint, to the upper ends of adjacent twin fulcrum arms 228*a*, 228*b*, the lower ends (bases) of which are hingedly mounted by pins 229*a*, 229*b* to a flange 230 protruding from the lower end of guide track 220. The bases of these fulcrum arms 228*a*, 228*b* are mounted in such a way that at least part of the upper portions of the fulcrums seat outside of guide track 220, in a scissor-like manner, when the lever 212 is in the closed position. In an alternative embodiment (not shown) the twin fulcrums may be replaced by a single, channel-shaped fulcrum arm.

In the illustrated embodiment of the invention, the lever is spring-loaded by a tensile spring 218 which is seated between the twin fulcrum arms, and is mounted at a lower end to the guide track 220, being secured by rod 231. The upper end of the spring is secured to rod 232 which spans the space between the upper end of the twin fulcrums 228*a*, 228*b* and serves to mount the fulcrums to the lever 212. The rod 232, which secures the spring 218 to the lever 212, is preferably mounted to the lever at a location on the lever outside (away from the toe of boot) of the lateral midpoint of the lever. Such a mounting configuration results in a spring-loaded lever 212 which is biased to both the full open and full closed positions. The lever may also be mounted in such a way that it is not spring-loaded.

In either embodiment the rod 232, which mounts the upper end of the fulcrum to lever 212, is positioned at a first, lesser distance from the calf cuff 14 than are pins 229*a*, 229*b*, which mount the fulcrum to a flange 230 adjacent the lower end of the guide track 220. Such a mounting configuration imparts an over-center action to the lever such that the lever is biased to either the closed position (when not spring loaded), or the full open and full closed positions (when spring loaded).

As illustrated in FIGS. 2*a* and 4, cable 214 is preferably a continuous single length of material which encompasses each side of the boot 10, and which is operatively connected to the latch mechanism 211. The cable 214 can be viewed as having a sucession of strands 214*a*, *b*, *c*, *d*, *e*, and *f* which cooperate with the latch mechanism 211 to open and close the boot. Cable strand 214*a* is generally located on the upper portion of either side of the calf cuff 14 of the boot. Cable strand 214*b* is located on the lower portion of either side of the calf cuff 14 of the boot. At their forward ends, strands 214*a* and 214*b* meet, on either side of the boot to be secured to a strap 216 (or similar support means) mounted to the shin cuff 16 of the boot. At its rearward end, left and right portions (as viewed from the rear of the boot) of strand 214*a* pass through apertures (not shown) on the upper portion of the lever to meeet at a position directly behind (away from the toe of the boot) the guide track 220 as cable strand 214*f*. At its rearward end the right and left portions of cable strand 214*b* pass by sheaves 221*a* and 221*b*, respectively, on the guide track 220. The right and left portions of strand 214*b* then become strands 214*c* and 214*d*, respectively, and are threaded upwardly through the central channel 224. At the upper portion of the lever 212, strands 214*c* and 214*d* join as cable strand 214*e* which is anchored to the upper end of the lever 212 as it is retained in an aperture 24 in a flange 248 on the level 212. The position of this anchorage may be adjustable to vary the effective length of the cable to accomodate a variety of leg sizes.

Preferably, the cable system of this invention is substantially concealed by cosmetic features on the shell of the boot, or the cable system is received within channels on the face of the boot to improve the aesthetic appearance of the boot.

The length of the cable 214 will necessarily vary with various boot styles and sizes. However, one skilled in the art, upon reading the disclosure, will be readily able to select a cable of the appropriate length.

The operation of the closure mechanism 210 is best illustrated by reference to FIGS. 1 through 3. In FIG. 1 the boot is closed when lever 212 is substantially flush against the calf cuff 14 and cable strands 214*a* and 214*b* are relatively short in length and high on the boot, thereby holding the shin cuff 16 and calf cuff 14 together in frictional engagement.

In FIG. 2, as the lever 212 is pivoted upwardly about pins 226*a*, 226*b*, and rod 232, pins 226*a*, 226*b* simultaneously slide downwardly within guide track channels 222*a*, 222*b*. At the same time the fulcrum arm 228 is pulled away from the guide track 220. This action lowers the upper end of the lever 212 which contains flange 248 and cable strand 214*e*, thereby shortening the lengths of cable strands 214*c* and 214*d* while lengthening cable strands 214*a* and 214*b*.

As the lever 212 is further pivoted and lowered on the guide track 220, as in FIG. 3, cable strands 214*a*, and 214*b* are further lengthened as the flange 248 of lever 212 reaches its lowest position, allowing the boot to open fully as the calf cuff 14 and shin cuff 16 separate. When the boot is in the open position the wearer's foot may easily enter and exit the boot.

Pivoting the lever 212 downwardly to close the boot will reverse the actions described above, causing cable strands 214*a* and 214*b* to be raised and become shorter while the cable strands 214*c* and 214*d* are lengthened. As the cable strands 214*a* and 214*b* are raised and become increasingly shorter, the size of the opening between calf cuff 14 and shin cuff 16 decreases. Eventually, the cable strands will be fully raised and shortened when the lever 212 is fully closed and the calf cuff 14 and shin cuff 16 are frictionally engaged.

Although not illustrated, it is understood that one skilled in the art will be capable of providing a mechanism for adjusting the tension on the cable system 214 to accomodate the needs and desires of a given wearer.

It is also noted that one skilled in the art could interpret the above description to disclose a ski boot closure system wherein the latch mechanism is mounted to the shin cuff, or front of a ski boot, rather than to the calf cuff.

The following claims are intended to cover all of the generic and specific features of the invention described herein, and all statements of the scope of the invention which, as a matter of language, might be said to fall there between.

Having described the invention, what is claimed as new and secured by Letters Patent is:

1. In a ski boot having a base element providing sole, toe and instep portions, a forward shin-cuff element mounted to said base element for supportingly engaging the shin of a wearer, a calf cuff element hingedly mounted to said base element for supportingly engaging the calf of a wearer, said cuff elements being movable between closed positions for providing said supporting engagements, and open positions for allowing a wearer to step into and out of the base element, and further having the improvement comprising a closure system for opening and closing said ski boot, said closure system comprising (a) a cable system having height and length varying cable strands secured between one said cuff and a latch means mounted to the other said cuff, (b) a means for slidably securing said cable strands to said one cuff, (c) a latch means comprising a guide track and a lever, said guide track being mounted to the other said cuff, said lever being adapted for movement between open and closed positions, and (d) said cable system having first, second, and third strand portions, said forst portion extending on a first side of said boot from connection with said lever to said slideable securing with said one cuff and continuing to engagement with said guide track, said third portion extending on the other opposite side of said boot from connection with said lever to said slideable securing with said one cuff and continuing to engagement with said guide track, and said second portion interconnecting said first and third portions at the engagements thereof with said guide track and extending along said guide track for a length which changes with the position of said lever between said open and closed positions.

2. In a ski boot according to claim 1, the further improvement wherein a strap is mounted to a front portion of said one cuff for slidably engaging said cable strands.

3. In a ski boot according to claim 2, the improvement wherein a spring means is engaged between said guide track and said lever for providing spring loading of said latch means.

4. In a ski boot according to claim 3, the improvement wherein said lever is pivotally mounted and vertically moveable, at one end, to accomodate opening and closing of said boot.

5. In a ski boot according to claim 4, the improvement wherein said cable strands are secured to said lever, and pivotal and vertical movement of said lever to an open position lowers and lengthens said cable strands to open said boot.

6. In a ski boot according to claim 4, the improvement wherein said cable strands are secured to said lever, and pivotal and vertical movement of said lever to a closed position elevates and shortens said cable strands to close said boot.

7. A ski boot closure for opening and closing a rear entry ski boot comprising a length-variable cable means connected between forward and rearward portions of said boot, and a latching means carried on one portion of said boot and coupled with said cable means at at least two locations therealong which are separated along said cable means by connection with the other portion of said boot, said latching means being adapted for movement between open and closed positions, said open position effecting a relative lengthening of said cable means to open said boot, and said closed position effecting a relative shortening of said cable means to close said boot.

8. A ski boot closure apparatus for a rear-entry ski boot having a foot-supporting base element, a forward shin cuff element for supportingly engaging the shin of the wearer, a rear calf cuff element hingedly mounted adjacent the lower end thereof to said base element for supportingly engaging th calf of the wearer, said calf cuff element being movable relative to said base element between closed positions for allowing a wearer to step into and out of the base element, and further having the improvement comprising (a) lever means having a handle portion at a first end opposite a second end thereof, (b) slide means on said rear cuff element for mounting said second end of said lever means for sliding motion along a selected portion of the height of said rear cuff element, (c) arm means hingedly connected at a first end to said lever means intermediate said first and second ends thereof and hingedly connected at the opposite end thereof to said rear calf cuff element below said selected portion of said rear cuff element, said arms means supporting said lever means for movement between a closed position where said second lever means end is uppermost on said selected portion of said rear cuff element and an open position where said lever means second end is spaced a first distance therebelow, (d) sheave means carried on said rear cuff element below said selected portion of said rear cuff element and aligned with the movement of said lever means second end between said open and closed positions thereof, (e) means forming at least one tensile strap having one end secured to said lever means adjacent to said second end thereof and threading therefrom to engage said front shin cuff and further threading successively around said sheave menas and along said portion of said rear cuff element to fasten to said lever means adjacent said second end thereof, whereby a first length of said tensile strap is constrained between said second end of said lever means and said sheave means when said lever neans is in said closed position and a significantly lesser length of said tensile strap is so constrained when said lever means is in said open position.

9. A closure according to claim 8, the further improvement wherein said lever is spring-loaded with a spring means mounted at a first end adjacent the lower end of said slide means and at a second end to said lever means proximate the mounting point of said arm means, said spring-loaded lever being biased to both the full open and full closed positions.

10. A closure according to claim 8, the further improvement wherein said arm means is mounted at a first end at a first distance from said calf cuff and at a second end to a flange means adjacent the lower end of said slide means at a second distance from said calf cuff, said second distance being greater than said first distance such that said lever is movable between open and closed positions with an over-center action and is biased to the closed position.

11. A closure according to claim 8, the further improvement wherein said closure comprises a second sheave means carried on said rear cuff element opposite said first sheave means and a second tensile strap opposite and symetrical to said first tensile strap.

12. A closure according to claim 11, the further improvement wherein said tensile strap is continuous and stems from said lever means and passes around either side of the calf cuff element and is secured to the forward shin cuff.

* * * * *